US008037801B2

(12) United States Patent
Coiffet et al.

(10) Patent No.: US 8,037,801 B2
(45) Date of Patent: Oct. 18, 2011

(54) LINK SEPARATION DEVICE FOR AN AMMUNITION BELT

(75) Inventors: Pierre Coiffet, Saint Martin la Plaine (FR); Jean-Louis Sennegon, Voisins le Bretonneux (FR)

(73) Assignee: Nexter Systems, Roanne Cedex (FR)

( * ) Notice: Subject to any disclaimer, the term of this patent is extended or adjusted under 35 U.S.C. 154(b) by 302 days.

(21) Appl. No.: 12/382,927

(22) Filed: Mar. 26, 2009

(65) Prior Publication Data

US 2009/0249947 A1 Oct. 8, 2009

(30) Foreign Application Priority Data

Apr. 2, 2008 (FR) ..... 08 01848

(51) Int. Cl.
*F42B 39/08* (2006.01)

(52) U.S. Cl. ..... 89/35.02; 89/33.14

(58) Field of Classification Search ..... 89/33.14, 89/33.2, 35.01, 35.02
See application file for complete search history.

(56) References Cited

U.S. PATENT DOCUMENTS

| | | | | |
|---|---|---|---|---|
| 2,345,340 A | | 3/1944 | Howe | |
| 2,418,428 A | * | 4/1947 | Rundquist | 89/33.2 |
| 2,467,571 A | | 4/1949 | Webb | |
| 2,803,169 A | * | 8/1957 | Linke | 89/33.25 |
| 3,229,584 A | * | 1/1966 | Zehuder | 89/33.25 |
| 3,367,236 A | * | 2/1968 | Menneking | 89/33.25 |
| 4,004,492 A | * | 1/1977 | Savioli | 89/35.02 |
| 7,578,226 B2 | * | 8/2009 | Moucheboeuf et al. | 89/35.02 |
| 2008/0245219 A1 | * | 10/2008 | Moucheboeuf et al. | 89/35.02 |

FOREIGN PATENT DOCUMENTS

| | | | |
|---|---|---|---|
| EP | 1985960 A1 | * | 10/2008 |
| FR | 2 849 498 A1 | | 7/2004 |

* cited by examiner

*Primary Examiner* — Benjamin P Lee
(74) *Attorney, Agent, or Firm* — Oliff & Berridge, PLC

(57) ABSTRACT

A link separation device for an ammunition belt, said belt exiting a weapon after firing via an opening and in which an assembly of links (M1, M2) are mounted able to pivot angularly with respect to one another, each of said links incorporating two lateral stirrups and one median stirrup, said median stirrup of a first link (M1) of said links being able to pivot in grooves in said lateral stirrups of a second link (M2) of said links, a relative pivoting position of said first link (M1) with respect to said second link (M2) following said first link (M1) enabling said first link (M1) to be unhooked, said links additionally being positioned with respect to said device in a position such that the pivoting ensuring the unlocking and the unhooking of said first link (M1) can be made naturally by the action of gravity exerted on said first link (M1), wherein said device incorporates means to ensure said first link (M1) rocks over as well as means to guide and means to support said second link (M2) following as said first link (M1) is rocking over.

10 Claims, 4 Drawing Sheets

LINK SEPARATION DEVICE FOR AN AMMUNITION BELT

BACKGROUND OF THE INVENTION

1. Field of the Invention

The technical scope of the invention is that of ammunition feed devices for a weapon and, in particular, that of devices enabling the links to be separated from one another upon exiting the weapon after the ammunition has been fired.

2. Description of the Related Art

Ammunition fired from medium caliber (caliber of between 20 mm and 50 mm) weapons are generally assembled on link chains or belts. These belts enable the introduction of the ammunition into the weapon to be facilitated. The ammunition is stored in rounds in a magazine with its belt. The belt enables it to be conducted to the weapon following feed channels. The feed system of the weapon also brings each round one after the other until it faces the weapon chamber where the correctly positioned round is extracted from its belt to be fired.

The round of ammunition may be extracted from its link upon entering the weapon and then be taken up by the weapon before being chambered. The belt thereafter exits the weapon after being relieved of its ammunition.

In certain weapon systems, namely systems mounted on a turret and for which there is a problem of space inside the turret, it is necessary for the link belts to be evacuated to the outside of the turret or else for them to be stored in the turret in the smallest space possible.

However, the link belts are still linked together and clump to form blocks integral with the turret, which can hinder the implementation of the turret.

Different devices have been perfected to enable the separation of the different links of the belt upon exiting the weapon or the turret.

Naturally, any solution for a link separation device will be specific to the architecture of the link belt.

The invention more particularly relates to a device intended to separate the links of a belt in which the links are mounted able to pivot angularly with respect to one another, a relative pivoting position of one link with respect to the adjacent one enabling the first to be unhooked.

Such a link belt structure is well known to someone skilled in the art and described namely by NATO standard STANAG n°4173 for ammunition of 25×137 mm caliber.

FIG. 1*a* thus shows two links M1, M2 of such a belt, separated from one another, whereas FIG. 1*b* shows these links assembled.

We see that each link incorporates a median stirrup 1 and two lateral stirrups 2. Each stirrup is partially cylindrical in shape so as to receive a round of ammunition. The median stirrup 1 of link M2 incorporates circular ribs 3 that cooperate with circular grooves 4 on the lateral stirrups 2 of link M1.

Thus, as can be seen in FIG. 1*b* when links M1 and M2 are assembled, the median stirrup of one is positioned between the lateral stirrups of the other and a relative pivoting of M1 with respect to M2 is made possible by the cooperation of the ribs 3 with the grooves 4.

Belts of links are thus formed that are sufficiently flexible to allow them to be conducted through the channels in the weapon.

When the ammunition is put into position in the belt, it does not prevent the links from pivoting with respect to one another, but acts rather as a hinge and link between the lateral stirrups of one link and the median stirrup of the adjacent link and this whatever the curvature of the belt.

However, when the ammunition has been removed, it is possible for the links to be separated after having made them to pivot until they have reached the correct angular position with respect to one another, thus enabling them to be removed from the belt.

Patent FR-2849498 proposes a link separation device in which an elastic tab is positioned below the point at which the belt exits the weapon. This tab is intended, by guiding the exiting link upwards, to make it pivot with respect to the following link thereby enabling the links to be separated from one another.

This device is intended to ensure the separation of the links for a weapon system that incorporates a feed system for two different types of ammunition (piercing ammunition and explosive ammunition). These weapon systems are well known; they incorporate two separate feed channels. The links exit from two different exit points.

Patent FR-2849498 schematically shows these two link exit points. The links that exit in the lower part are oriented with their lateral and median stirrups open to the top. They are not able to pivot naturally through the action of gravity and specific means such as those described in FR-2849498 must be provided to separate the links.

The links that exit in the upper part are oriented downwards with their lateral and median stirrups open to the bottom. The effect of gravity naturally leads the exiting link to pivot with respect to the following one when it is no longer supported by the feed channel. Thus, patent FR-2849498 proposes to allow the links to separate by themselves through the simple effect of gravity. A simple guidance channel is provided to guide the links away from the weapon and to allow them to separate at a distance.

However this solution incorporates drawbacks.

There is noted in fact the simple natural releasable of the links from one another by gravity is not reliable. Rubbings inter links are present and are different from one link to an another. The separation is not automatic from the outside of the links out of the guidance channel. Moreover the effect of the gravity forces upon the links depends on the firing sight of the weapon. There is then a problem with respect to the liability of the unlinking when the gravity effect is used in order to separate the links.

Lastly, the device known by FR-2849498 incorporates a substantial channel length which encumbers the area dedicated to the evacuation of the links, both for the upper part evacuation and the lower part evacuation.

There is a non-negligible risk of forming a clump of links that will obstruct the unlinking or evacuation of the links. In fact, when a link remains attached to its adjacent one, the latter is no longer able to pivot since its pivoting capacity is reduced. This results in the exiting of belts with the links still attached, thereby braking the exiting of the belt and leading to a blockage of the weapon.

SUMMARY OF THE INVENTION

The aim of the invention is to propose a device that is simple in design and does not take up much space but which enables the separation of the links exiting in the upper part to be made more reliable, links which are naturally driven by gravity to pivot with respect to one another.

Thus, the invention relates to a link separation device for an ammunition belt, such belt exiting the weapon after firing via an opening and in which the links are mounted able to pivot angularly with respect to one another, each link incorporating two lateral stirrups and one median stirrup, the median stirrup of link M1 being able to pivot in the grooves in the lateral stirrups of the following link M2, a relative pivoting position of a first link (M1) with respect to the link (M2) following it enabling the first link to be unhooked, the links additionally being positioned with respect to the device in a position such that the pivoting ensuring the unlocking and the unhooking of the first link can be made naturally by the action of gravity exerted on the first link, device wherein it incorporates means to ensure the first link (M1) rocks over as well as means to guide and support the following link (M2) as the first one (M1) is tipping over.

The rocking means may be constituted by at least one elastic blade positioned above the exit opening of the belt, such blade pressing against the body of the first link when the following link is being supported by the guidance means.

The rocking means may thus be constituted by two elastic blades each intended to cooperate with a lateral stirrup of the first link.

Furthermore, the means to support and guide the links may be constituted by at least two substantially horizontal fins cooperating with the tabs integral with the body of the following link.

The fins extend advantageously towards the inside of the opening so as to support two adjacent links.

The link separate device may also incorporate separation means constituted by at least one rigid blade intended to form a limit stop for the median stirrup of the first link.

Advantageously, the device will incorporate a deflector arranged below the exit opening.

The deflector may be constituted by a plate integral with a guiding channel for the links.

BRIEF DESCRIPTION OF THE DRAWINGS

The invention will become more apparent from the following description made with reference to the appended drawings, in which.

DETAILED DESCRIPTION OF PREFERRED EMBODIMENTS

Figure 1A:
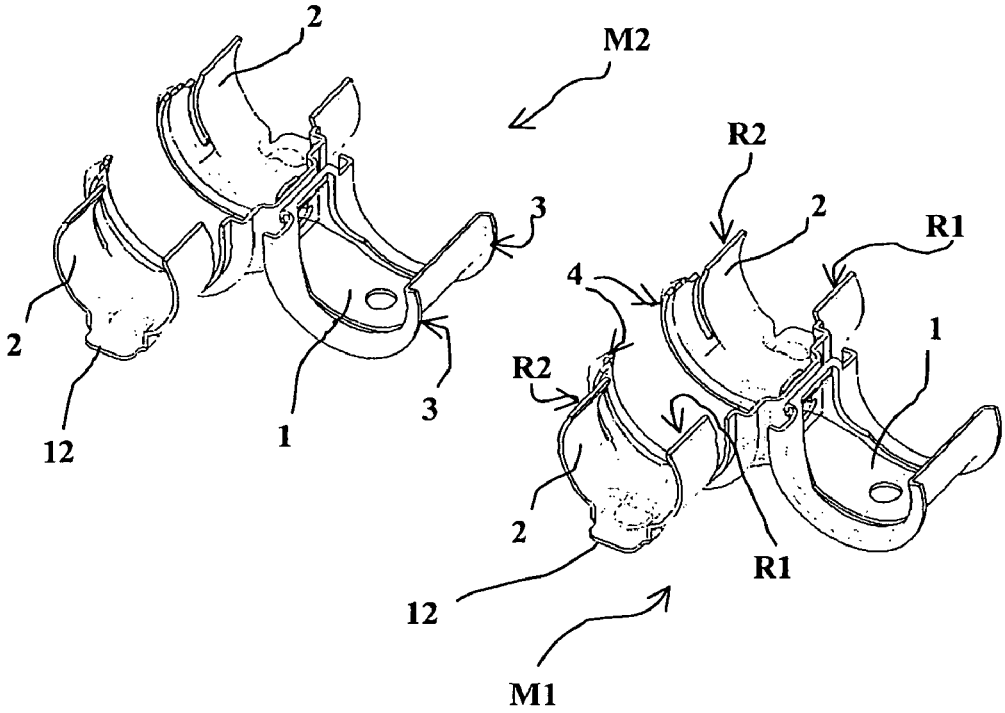
FIGS. 1*a* and 1*b* shows a perspective view of the links of an ammunition belt that the invention proposes to separate automatically.
Figure 1B:
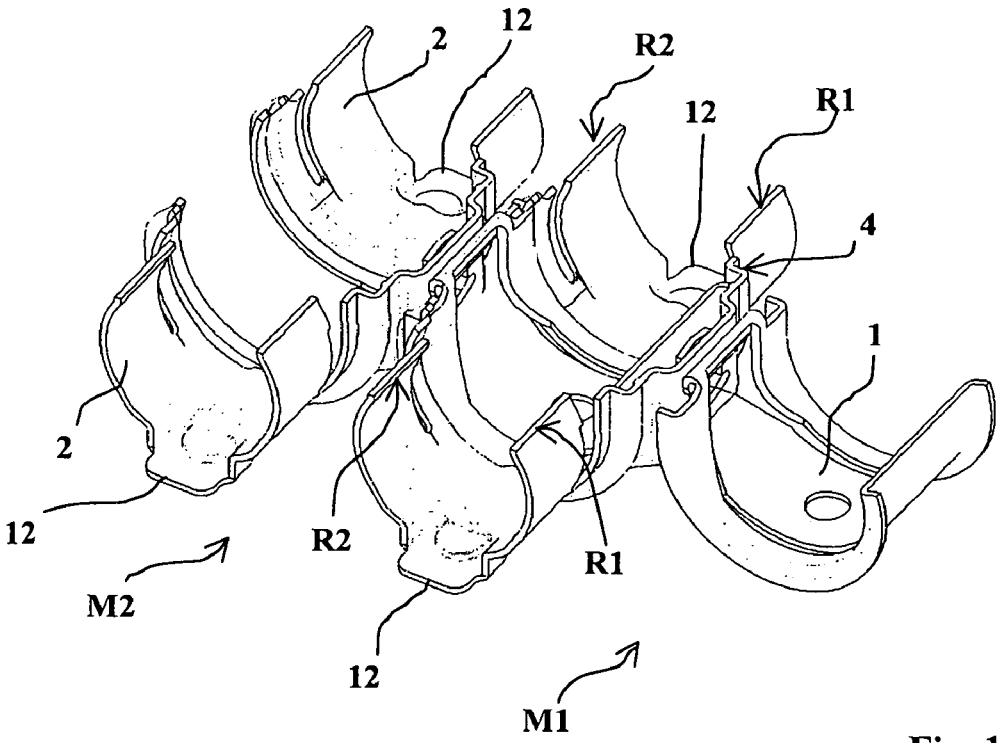

FIGS. 1*a* and 1*b* have been described in the preamble to the present application. Their only purpose is to specify the structure of the adjacent links M1, M2 of an ammunition belt, which the invention proposes to dissociate.

Figure 2:
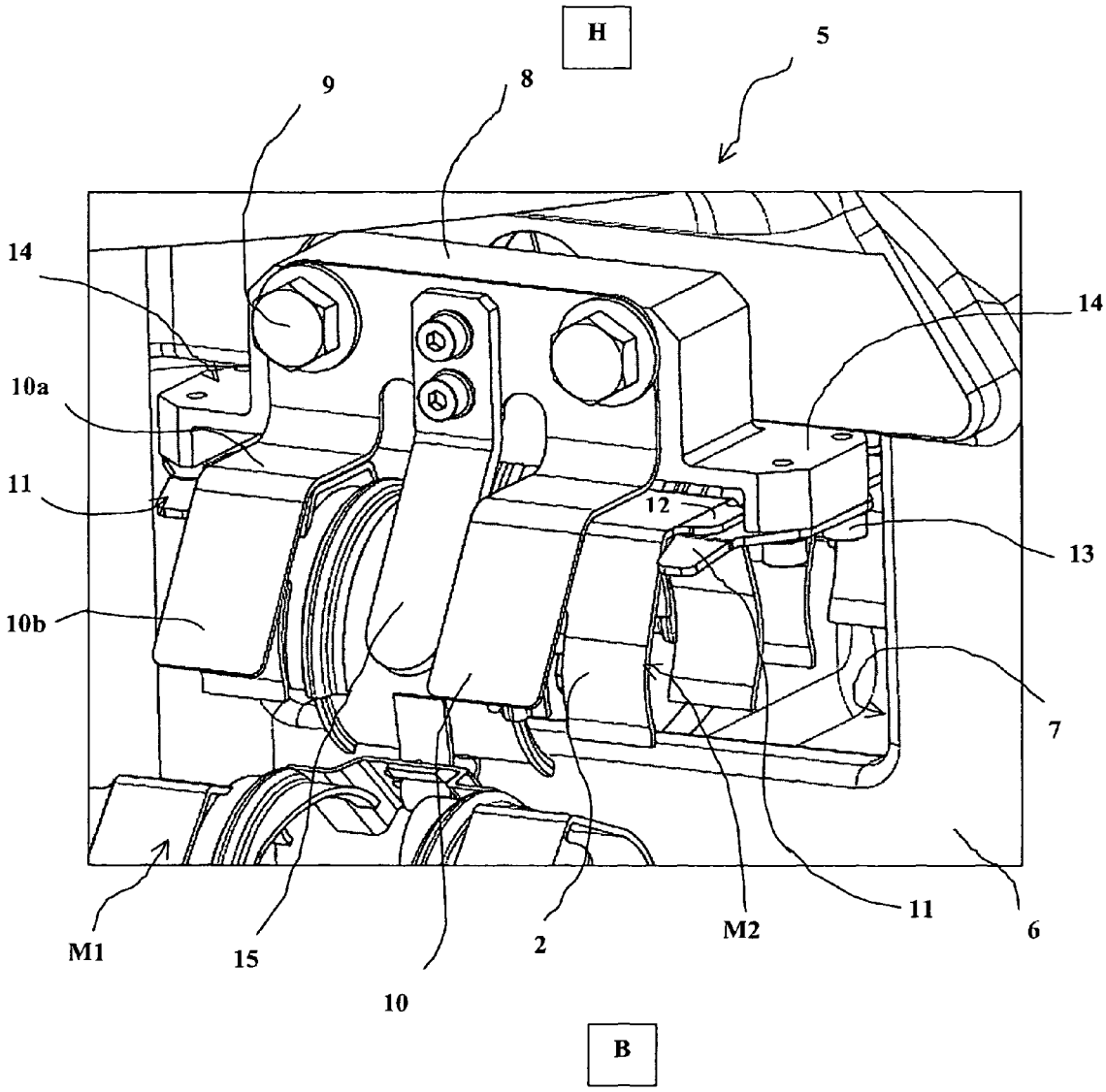
FIG. 2 is a perspective view showing the belt exit with one embodiment of a separation device according to the invention.

FIG. 2 shows an embodiment of a separation device 5 for the links M1, M2 of a belt. In this Figure, a wall 6 is featured integral with the weapon (not shown) or turret. An opening 7 is arranged in this wall to enable the belt to exit.

In FIG. 2, the letters H and B indicate the top (H) and bottom (B). We can thus see on this Figure that the links M exit the opening 7 oriented with their stirrups 2 open to the bottom B. In this orientation the force of gravity causes the first link M1 to pivot naturally with respect to the second one M2 when it is no longer supported. Furthermore, because of the assembly of the weapon being implemented here, it is the lateral stirrups 2 of a link M that exit first.

The device 5 according to the invention comprises a support 8 that is attached for example by screws 9 to the wall 6. This support 8 has two elastic blades 10 that are fixed to the support 8 above the exit opening 7 for the belt. These elastic blades are made of spring steel. They incorporate a substantially horizontal part 10*a* extended by an inclined part 10*b*.

The blades 10*a*, 10*b* are integral with one another and are cut out of a single sheet. It would naturally be possible for two separate blades to be used.

The blades 10 are intended to press against the body of the link M as it exits the opening 7 and more particularly against the external profile of the lateral stirrups 2 of the link M.

Thus, each elastic blade 10 cooperates with a lateral stirrup 2 of the link.

The support 8 also incorporates two substantially horizontal fins 11 that cooperate with the tabs 12 integral with the body of the link (see also FIGS. 1*a* and 1*b* that show these tabs). The fins 11 provide support and guidance for the links M as they exit the opening 7.

These fins 11 are attached, for example by screws, to the lateral extensions 14 of the support 8.

The elastic blades 10 constitute means that will rock over a first link M1 exiting the opening 7. Furthermore, these fins 11 constitute the means to ensure support and guidance of the following link M2 as the first one M1 is being rocked over.

The fact of supporting a second link whilst exerting a pivoting torque on the lateral stirrups of the preceding link makes the separation of the links more reliable whatever the laying angle of the weapon. The elastic stress exerted by the blades 10 in fact completes the natural effect of gravity and overcomes the friction, which is variable from one link to another.

The support 8 lastly comprises a rigid blade 15, arranged between the elastic blades 10 and intended to form a limit stop for the median stirrup of the link 1. This steel blade also incorporates an inclined part. The value of the slant angle of this blade is selected as a function of the geometric characteristics of the links. The aim is for the median stirrup to butt against these blades when it has already pivoted with respect to the lateral stirrups of the following link. The blade 15 thus forms separation means that give a momentum thereby making the separation of the links more reliable. The time of separation of the links that follows the weapon's firing cycle is thus controlled.

The functioning of the invention will now be described with reference to FIGS. 3*a* to 3*d*.

These Figures are very schematic since their only purpose is to help explain the functioning.

Figure 3A:
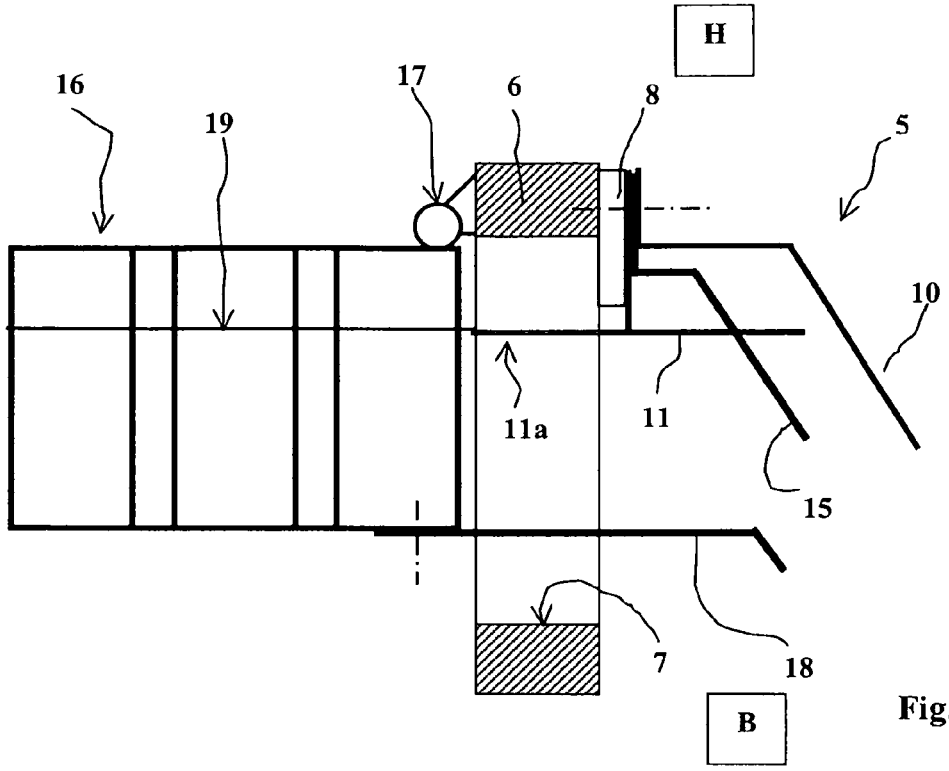
FIGS. 3*a*, 3*b*, 3*c* and 3*d* show different successive phases of the functioning of the device according to the invention.

FIG. 3*a* shows the device alone before the link belt has been put into place. This Figure also shows a flexible channel 16 that guides the link belts. The flexible channel 16 is fitted with guide rails 19 on which the tabs 12 of the different links slide. The channel 16 is linked to the wall 6 by its upper part by means of a hinge 17. The lower part of the channel 16 is free and presses on the wall 6.

During a feed change, the channel 16 pivots on its hinge 17 and its lower part moves away from the wall 6.

According to another characteristic of the invention, a deflector 18 is fastened below the exit opening 7. This deflector enables the links to be guided as they fall and in particular prevents the links from falling on the unlinking device of the lower channel (when a double feed weapon such as that described in patent FR-2849498 is implemented).

This deflector 18 may be integral with the wall 6. It is, however, more advantageous to fit it to the channel 16 as shown in the Figures. Indeed, in this case (and always within the scope of the implementation of a double-feed weapon), when the upper channel is inactive, the mechanics of the weapon control the pivoting of the channel 16 inside the turret. The deflector 18 is thus also brought inside the turret.

Thus, there is no risk of its creating an obstacle for the links, namely for those from the lower channel (not shown). In fact, the latter are oriented with their stirrups open to the top. They are separated using a separate unlinking device (not described here) which pushes them upwards. These links risk bouncing on the deflector 18 then rebounding on the lower unlinking device causing the links to jam.

Figure 3B:
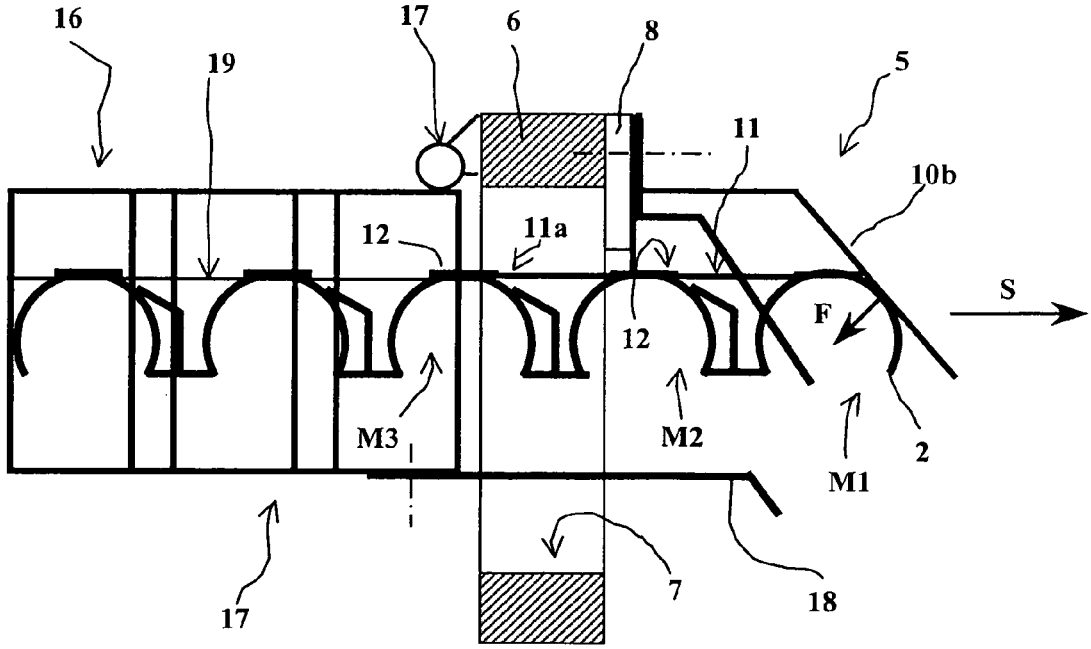

FIG. 3*b* shows a belt of links M exiting opening 7 in direction S.

The lateral stirrups 2 of the first link M1 come into contact with the inclined parts 10*b* of the elastic blades 10.

The latter deform, thereby creating a force F that is exerted on the lateral stirrups 2 of the first link M1. At the same time, the following link M2 is held in place by the fins 11, which support its tabs 12. As link M2 is supported, the force F creates a torque that ensures the reliable pivoting of link M1 with respect to link M2 whatever the friction.

Furthermore, link M1 is supported by guiding fins 11 until the lateral stirrups reach the blades 10. The space between the end of the guiding fins and the elastic blades 10 thus corresponds substantially to the length of the tabs 12.

As may be seen in FIGS. 3*a* to 3*d*, the fins 11 extend longitudinally towards the inside of the opening 7 to relay the guiding rails 19 of the link channel 16 and thus incorporate a rear part 11*a* that engages below the tabs 12 of the third link M3. Guidance for at least two adjacent links M is thereby always ensured at the opening 7. This improves the rigidity of such support and ensures reliable guidance for the exiting links.

The length of fins 11 is also such that after firing has stopped, the tabs 12 of the first link are still at least partially supported by the fins 11.

In the case of channels having no guiding rails 19, channels in which the links are guided by the structure of the channels itself, the end shape of the fins 11 may be adapted to ensure continuity in the guidance of the link between the channel and the unlinking device.

Figure 3C:
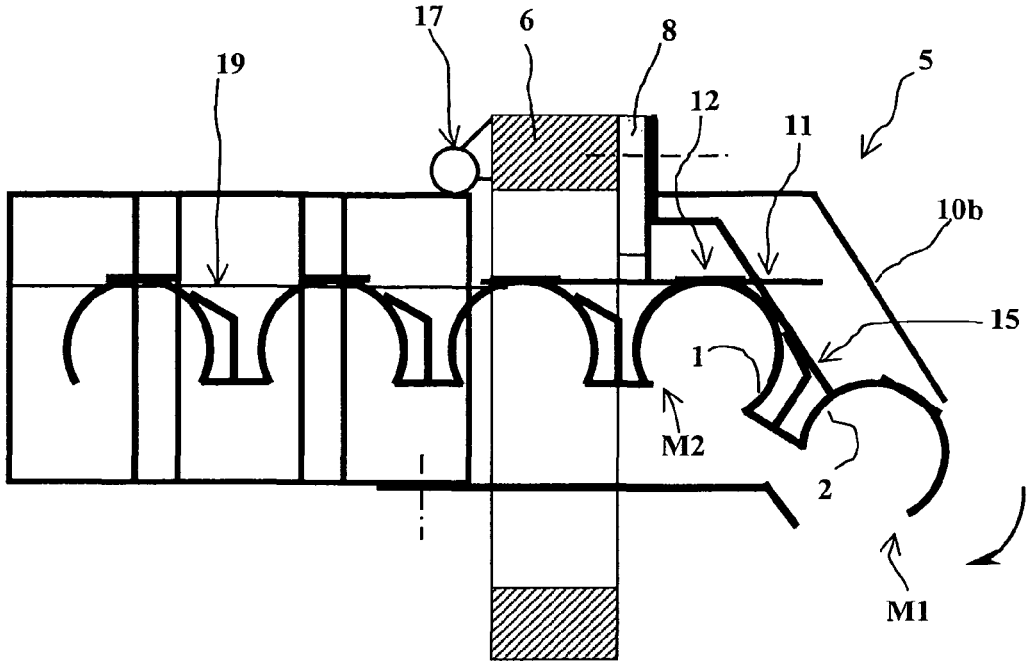

FIG. 3*c* shows link M1 almost fully pivoted. The median stirrup 1 of link M1 is coming into contact with the rigid blade 15 whereas the lateral stirrups 2 of link M2 are still be supported by the fins 11.

Figure 3D:
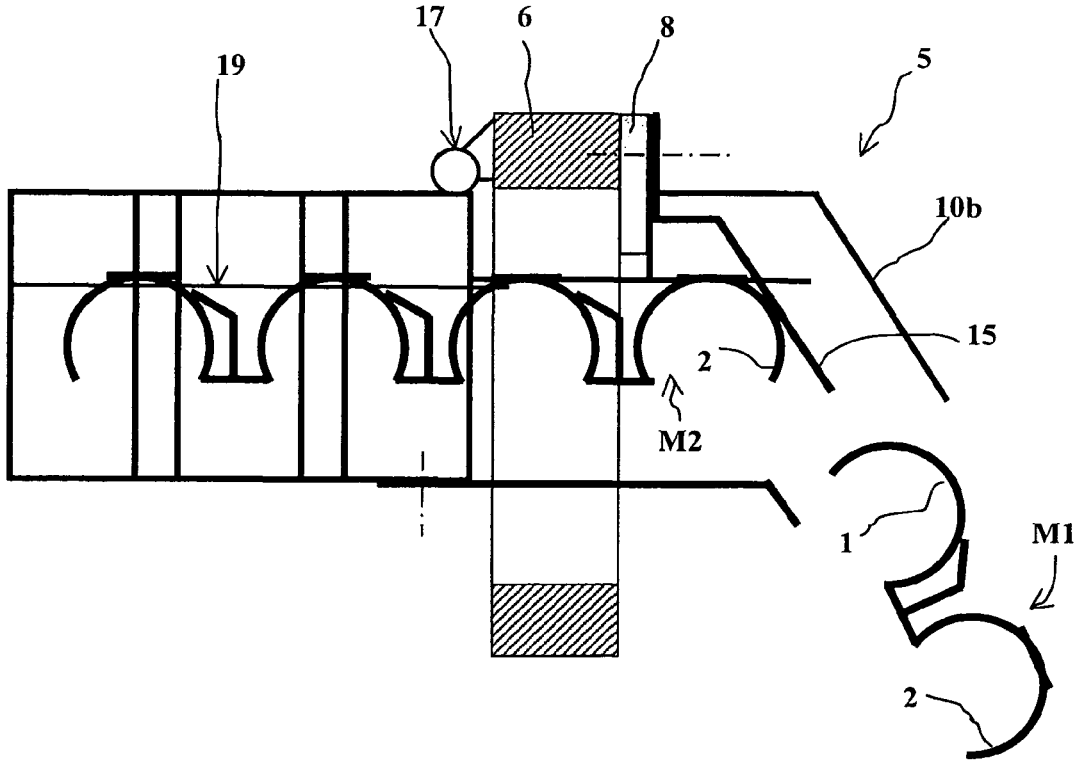

The rigid blade 15 gives momentum to the separation of the link M1, which falls out of the turret (FIG. 3*d*). The unlinking cycle thus continues in an identical manner for the other links.

What is claimed is:

1. A link separation device for an ammunition belt, said belt exiting a weapon after firing via an opening and in which an assembly of links (M1, M2) are mounted able to pivot angularly with respect to one another, each of said links incorporating two lateral stirrups and one median stirrup, each lateral stirrup and said one median stirrup are partially cylindrical in shape, said two lateral stirrups are configured to receive a first ammunition while said one median stirrup is configured to receive a second ammunition, said median stirrup of a first link (M1) of said links being able to pivot in grooves in said lateral stirrups of a second link (M2) of said links, a relative pivoting position of said first link (M1) with respect to said second link (M2) following said first link (M1) enabling said first link (M1) to be unhooked, said links additionally being positioned with respect to said device in a position such that the pivoting ensuring the unlocking and the unhooking of said first link (M1) can be made naturally by the action of gravity exerted on said first link (M1), wherein said device incorporates means to ensure said first link (M1) rocks over as well as means to guide and means to support said second link (M2) following as said first link (M1) is rocking over.

2. A link separation device according to claim 1, wherein said rocking means are constituted by at least one elastic blade positioned above the exit opening for said belt, said blade pressing against the body of said first link (M1) when a following link is being supported by the guidance means.

3. A link separation device according to claim 2, wherein said rocking means are constituted by two elastic blades each intended to cooperate with a lateral stirrup of said first link (M1).

4. A link separation device according to claim 1, wherein said means to support and guide said links are constituted by at least two substantially horizontal fins cooperating with tabs integral with the body of said second link (M2).

5. A link separation device according to claim 4, wherein said fins extend towards the inside of said opening so as to support two adjacent links.

6. A link separation device according to claim 1, wherein said device incorporates separation means constituted by at least one rigid blade intended to form a limit stop for said median stirrup of said first link (M1).

7. A link separation device according to claim 1, wherein said device incorporates a deflector arranged below said opening.

8. A link separation device according to claim 7, wherein said deflector is constituted by a plate integral with a guiding channel for said links.

9. A link separation device according to claim 6, wherein said device incorporates a deflector arranged below said opening.

10. A link separation device according to claim 4, wherein said device incorporates separation means constituted by at least one rigid blade intended to form a limit stop for said median stirrup of said first link (M1).

* * * * *